US005229981A

United States Patent [19]

Maschi

[11] Patent Number: 5,229,981

[45] Date of Patent: Jul. 20, 1993

[54] DIGITAL MULTI EVENT TIMER

[76] Inventor: Louis P. Maschi, 10 Lyle Ct., Staten Island, N.Y. 10306

[21] Appl. No.: 872,682

[22] Filed: Apr. 20, 1992

[51] Int. Cl.[5] ..... G04F 8/00

[52] U.S. Cl. ..... 368/111; 368/113

[58] Field of Search ..... 368/10, 82-84, 368/107-113; 364/529

[56] References Cited

U.S. PATENT DOCUMENTS

| | | | |
|---|---|---|---|
| 3,430,434 | 3/1969 | Piguet | 368/106 |
| 3,691,757 | 9/1972 | Merino et al. | 368/106 |
| 4,168,525 | 9/1979 | Russell | 364/569 |
| 4,731,768 | 3/1988 | Easterday | 368/118 |
| 4,797,864 | 1/1989 | Stano et al. | 368/111 |
| 4,837,719 | 6/1989 | McIntosh | 364/413.01 |
| 4,918,630 | 4/1990 | Plouff et al. | 364/569 |
| 4,991,156 | 2/1991 | Suga | 368/113 |

*Primary Examiner*—Vit W. Miska
*Attorney, Agent, or Firm*—Richard L. Miller

[57] ABSTRACT

A digital multi event timer that makes it simple to measure and record both time intervals and the actual times at which they begin. An electronic time base generates driving signals for seconds, minutes and hours. When a measurement set button is pressed, a counter begins at zero and counts up to the elapsed time count. Each time this button is pressed the beginning time and the interval are stored in non-volatile memory. The stored information can be retrieved from an ordered and index list. An independent index counter automatically stores data in the appropriate memory location. On retrieval, the user can manually scroll up or down the list.

20 Claims, 8 Drawing Sheets

SA0 : SET TIME/NORMAL
SA1 : SELECT HR/MIN
SA2 : TIME ADJUSTMENT
SA3 : SELECT TIME/INTERNAL
SA4 : VIEW UP
SA5 : RESET MEMORY POINTER
SA6 : MEASUREMENT SET
SA7 : VIEW DOWN
SA8 : SELECT TIME/MEASUREMENT

DIGITAL MULTI EVENT TIMER

BACKGROUND OF THE INVENTION

The instant invention relates generally to the field of timing instruments, and more specifically, to timing internal devices capable of storing data from successive interval measuring events. At the current state of the art, interval measuring equipment allows the measurement of perhaps one or two timing intervals, but does not store the time at which the intervals begin, nor are they capable of calculating intervals in rapid succession.

There are many application in which successive interval measurement is critical. For example, in obstetrics, the measurement of time intervals between contractions in labor is very haphazard. Typically, the practitioner will note the beginning of a contraction time on paper and further note the duration of the contraction. This manual approach is both cumbersome and inaccurate.

Several inventions have been offered which address this problem. A Hand Held Timer-Lap Counter Toy (U.S. Pat. No. 3,691,757) and Zero reset Mechanism for Timepieces Measuring Time Intervals (U.S. Pat. No. 3,430,434 by A. Piquet) offer mechanical solutions which are clearly outside the scope of this electronic embodiment. A Medication Clock (U.S. Pat. No. 4,837,719 by McIntosh, et al.) provides a general purpose medication clock that does not provide for interval measurement.

SUMMARY OF THE INVENTION

It is, therefore, a primary object of the present invention to provide a digital multi event timer that allows a user to make succesive interval measurements.

Another object is to provide a digital multi event timer that stores the actual time at which a timing interval begins.

Yet another object is to provide a digital multi event timer that begins a new interval measurement each time a MEASURE SET BUTTON is pressed.

Still another object is to provide a digital multi event timer that allows the user to scroll up and down through an indexed list of interval start times and durations.

Yet another object is to provide a digital multi event timer that stores the time/interval data in nonvolatile form until reset by the user.

A final object is to provide a digital multi event timer that consumes low power, is simple and inexpensive to build, and easy and intuitive to operate Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Overview

The digital multi event timer is a hand-held battery operated timing device that processes two timing functions:

1) a digital function displaying the current time; and
2) time interval measurement displaying time elapsed.

Figure 1:
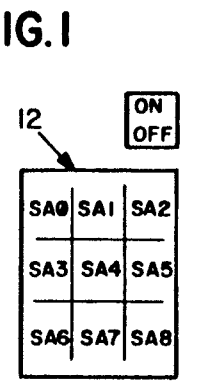
FIG. 1 is a diagrammatic representation of the keyboard.

The overall operation of the device can best be understood with reference to FIG. 1 which illustrates keyboard 12. To turn the device on and off, button the ON-OFF button is used. The device can record single or multiple time intervals by triggering the MEASUREMENT SET BUTTON, SA6, two or more times. Each time SA6 is pressed, it sets an end point for the previous measurement and a start point for the next time interval measurement. The 64 most recent measurements can be stored in the device's memory. This memory will not be cleared, even during power down, unless the user so desires.

Before operation begins, the user presses the SET TIME/NORMAL button SA0 to place the device into set time mode. The user can first adjust the hour by pressing the SELECT HOUR/MINUTE button, SA1. The hour can be adjusted by pressing the TIME ADJUST button, SA2, to advance the hours. The display is in the format of HH:MM:SS (hours, minutes, seconds). Similarly, SA1 is pressed again to adjust the minutes.

In operation each time another interval is to be recorded (for instance the time between contractions in labor), the MEASURE SET button, SA6 is pressed.

To retrieve the interval information, the user presses the SELECT TIME/MEASUREMENT button SA8, which changes the display from indicating actual clock time, to indicating interval measurements. All measurements are indexed, so they can easily be distinguished from one another. When SA8 is pressed, the display will alternate between "index:interval" and the starting time of that particular measurement "hour:minute:second". The user may look at a previously displayed interval by pressing the VIEW UP button SA4, or may look at a later interval by pressing the VIEW DOWN button SA7.

When interval data need no longer be displayed, the memory can be erased by pressing RESET MEMORY POINTER button SA5.

Figure 11:
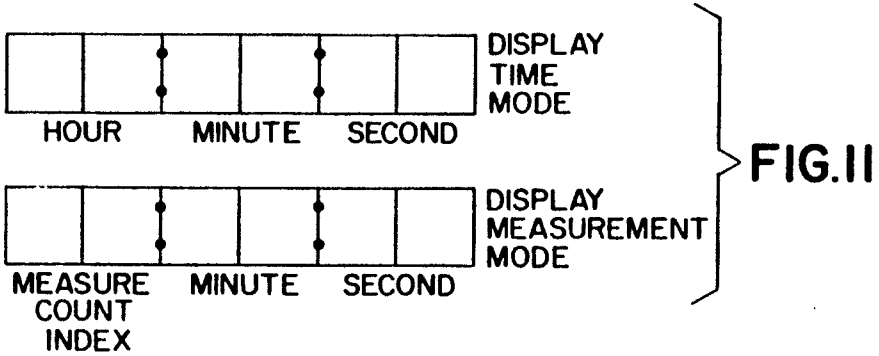
FIG. 11 is a diagrammatic representation of the display illustrating the time mode and the measurement mode.
Figure 10:
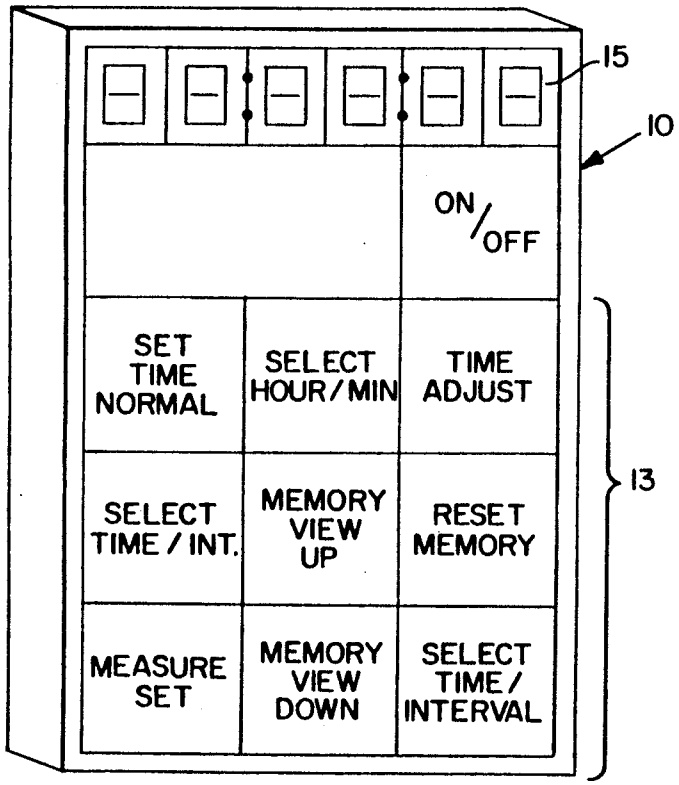
FIG. 10 is a diagrammatic representation of the instant invention per se.

The physical form of the invention 10 is illustrated in FIG. 10, which shows the keyboard 13, and the display 15. FIG. 11 is a diagrammatic representation of the display 12 illustrating the time mode and the measurement mode.

Circuit Description

Figure 9:
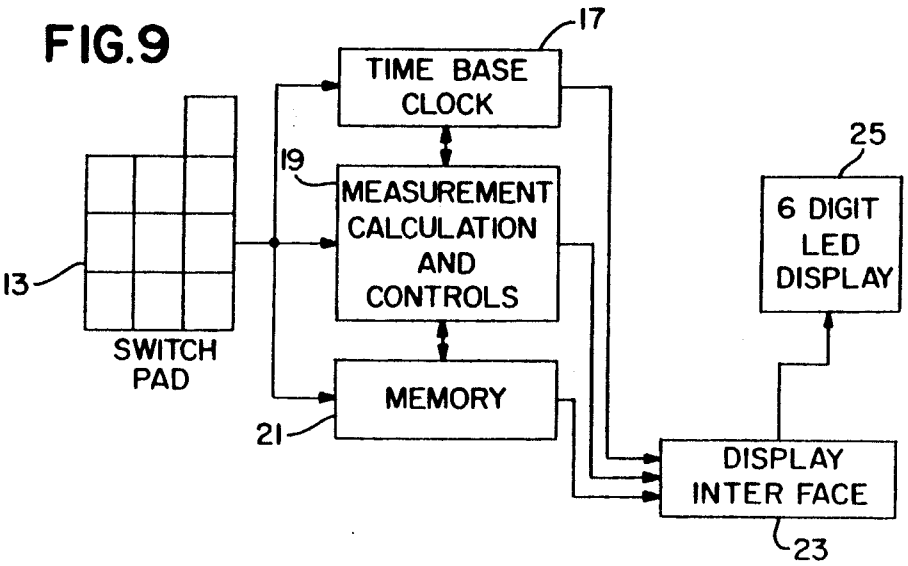
FIG. 9 is a simplified block diagram of the entire circuitry.

An overview of the circuit is illustrated in FIG. 9. A switch pad 13 provides the user interface. A time base clock 17 generates the needed internal clock signals needed by the device to operate in both the timing and interval modes. Measurement calculation and controls 19 provide the logic control over the modes of operation and provide means for successively generating interval data. Memory 21 comprises two parts: a memory for storing the time at which the interval has begun, and memory for storing the interval data. The display interface provides the Binary Coded Decimal outputs to drive the 6 digit LED display 25.

The detailed circuit description is best understood with reference to FIGS. 2 to 7. In this circuit, integrated circuits from the ubiquitous high speed CMOS series, HC, are used, although other integrated circuits with similar functions will create a functional digital multi event timer. In the following text: SIGNAL NAME~ means the logic signal is active low and SIGNAL NAME means the logic signal is active high.

Figure 2:
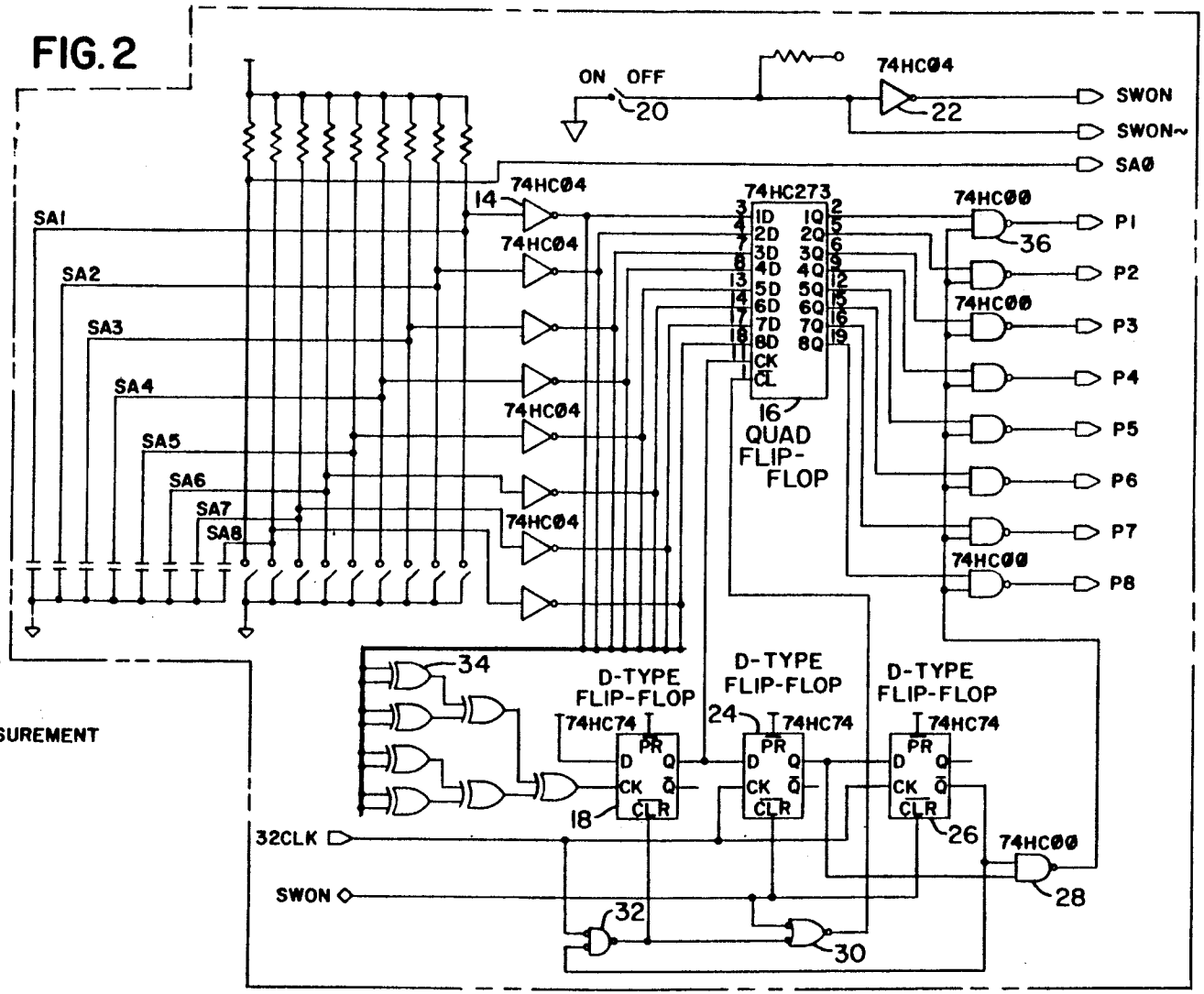
FIG. 2 is a block diagram illustrating the logic flow of the switch array circuitry.

FIG. 2 is a block diagram illustrating the logic flow of the switch array circuitry. The purpose of this block is to permit only one function to be enabled at a time and to keep that function latched on until another function is selected. The operation of ON/OFF switch 20, together with inverter 22 generates a switch on SWON signal and an inverted switch on SWON~ signal. When, for example, button SA1 is pressed, the switched signal is inverted by a 74HC04 inverter 14 and input to pin 3 of the 74HC273 octal flip-flop 16. This causes one of the flip-flops in a 74HC273 octal flip-flop to change state resulting in a latched output at pin 2. Similarly, depressing other buttons will cause corresponding pins of the octal flip-flop 16 to latch. The remainder of the logic comprises 74HC74 dual D-type flip-flops 18, 24 and 26, OR gates typified by 34, NAND gates typified by 36, and gates 32, 30 and 28. These logic elements 1) allow the latched states to change only in the presence of the 32 Hz clock 32 CLK; 2) clear the latches when SWON is first applied; and 3) allow only one main output P1 . . . P8 to be active at any time. P1 through P8 are function control signals which are directly related to SA0 to SA8.

Figure 3:
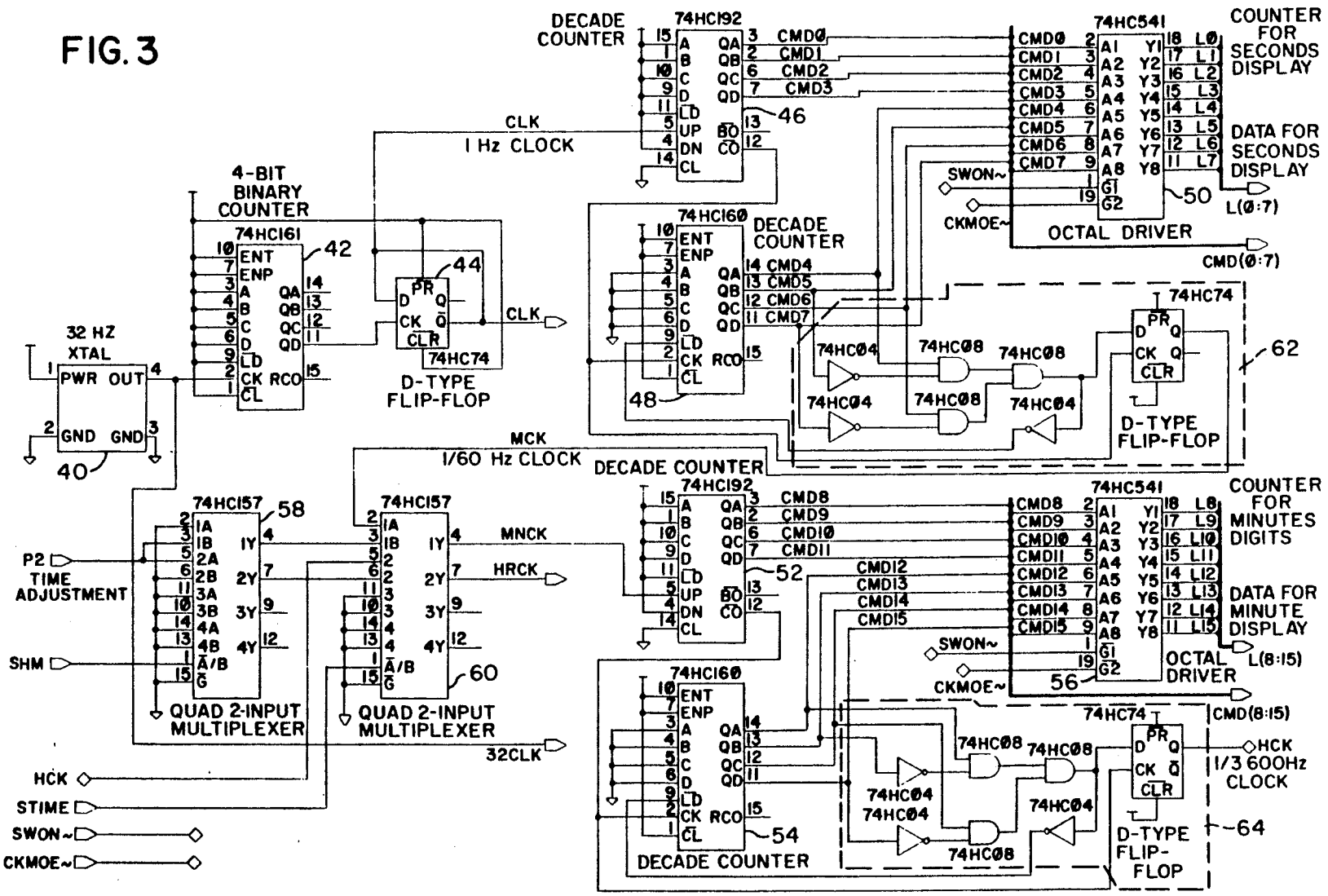
FIGS. 3 and 4 are block diagrams illustrating the logic flow of the time base circuitry.
Figure 4:
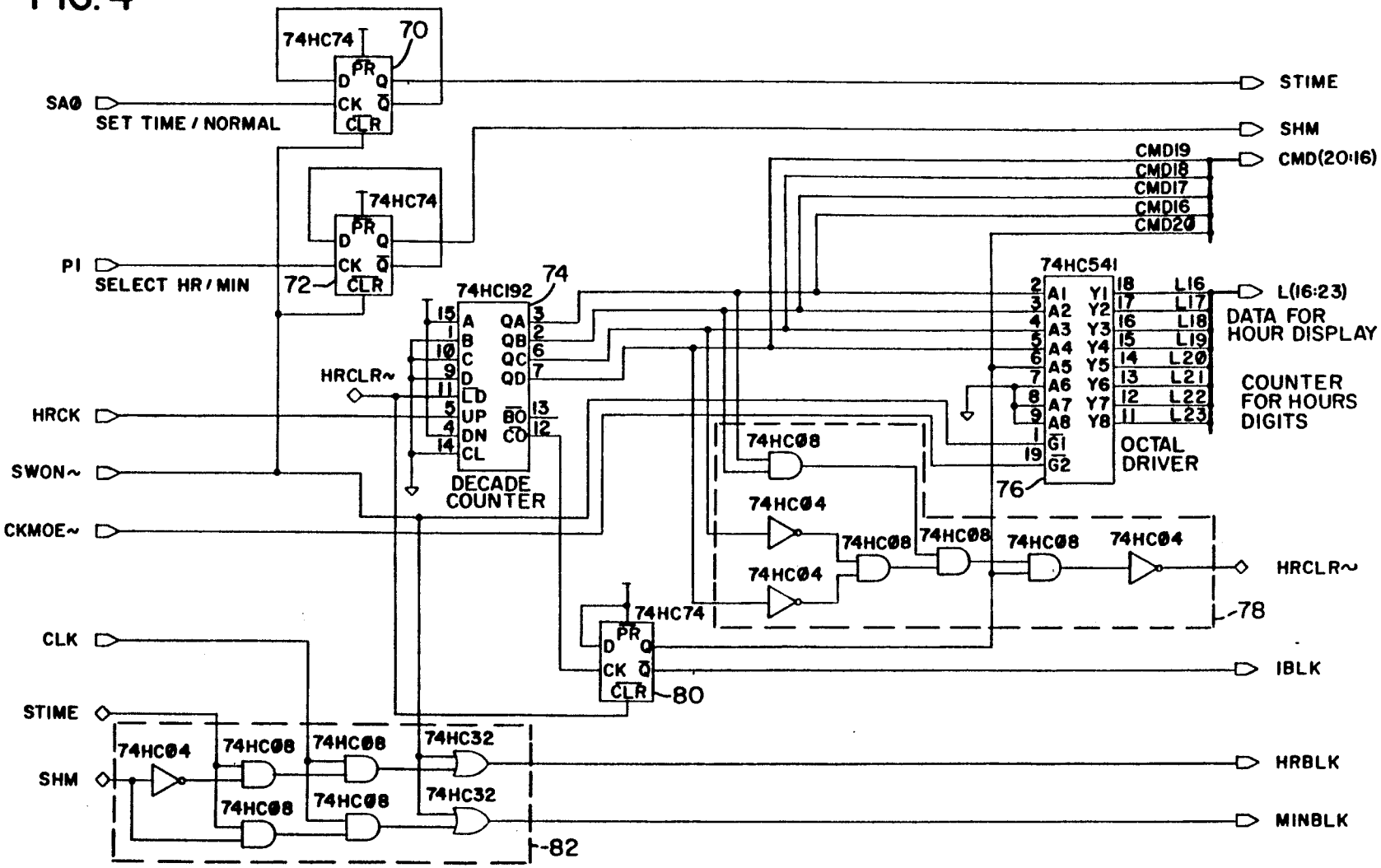

FIGS. 3 and 4 are block diagrams illustrating the logic flow of the time base circuitry. The following is with reference to FIG. 3. The 32 Hz clock signal CLK is generated by the 32 Hz crystal 40, 74HC161 4-bit binary counter 42 and 74HC74 D-type flip-flop 44. The 32 Hz clock signal (CLK) is input to a decade counter with BCD output comprising 74HC192 decade counter 46 and 74HC160 decade counter 48. This decade counter produces a decade count for seconds beginning at time=0 which is output at a low level to the CMD(0:7) bus and at a higher level to the L(0:7) bus via the 74HC541 octal driver (50). This BCD output is the seconds clock used in normal mode. Similarly, decade counters 52 and 54 and octal driver 56 comprise a minute clock used in normal time and interval mode. The counters are fed with the 1/60 Hz clock signal MCK. Two quad 2-input multiplexers 58 and 60 are used to set the minute and hour decade counters and hence the correct time. The SET HOUR/MINUTE (SHM) input to 58 enables the TIME ADJUSTMENT input to 58 to advance the decade counter 52 through input MNCK or to advance the hour clock (to be discussed below) through HRCK. The logic inside block 62 is used to generate the 1/60th Hz MCK minute clock signal and logic inside block 64 is used to generate the 1/3600th Hz HCK hour clock signal. The high level outputs L(0:7) and L(8–15) are only present when the clock mode enable signal, CKMOE, is present.

The following is with reference to FIG. 4 and discusses more of the time base logic circuitry. When the SA0 SET TIME/NORMAL button is pressed, 74HC74 D-type flip-flop 70 latches the set time signal (STIME) that is used in FIG. 3 to enable the device to set the time. When the device is switched on, the SWON~ signal automatically resets 70 so that the device is always in the normal mode when turned on. Similarly, when the SELECT HR/MIN button is pressed, 74HC74 D-type flip flop 72 latches the SET HOUR/-MINUTE (SHM) signal used in FIG. 3 to determine whether minutes or hours are being set. 74HC192 decade counter and 74HC541 octal driver 76 generate the low level decade hours bus CMD(20:16) and the high level L(16:23) bus used in the normal mode. The hours are set via the HRCK hours adjust signal which advances decade counter 74 to the desired hour setting. The hours output L(16:23) is only present when the clock mode enable signal, CKMOE, is present. The logic inside 78 is used to generate the hour clear, HRCLR~, signal used to reset decade counter 74. When the time is between 00:01 and 9:59 the leading 1 is blanked, while between 10:00 and 11:59 it is not. For this purpose, a one's blanking signal, 1BLK, is generated by flip-flop 80. Similarly, when the set time mode is activated by signal STIME, and hours setting or minutes setting is enabled by the SHM input, the logic in block 82 generates an hours blinking signal HRBLK during hours setting, and a minute blinking signal MINBLK during minutes setting.

Figure 5:
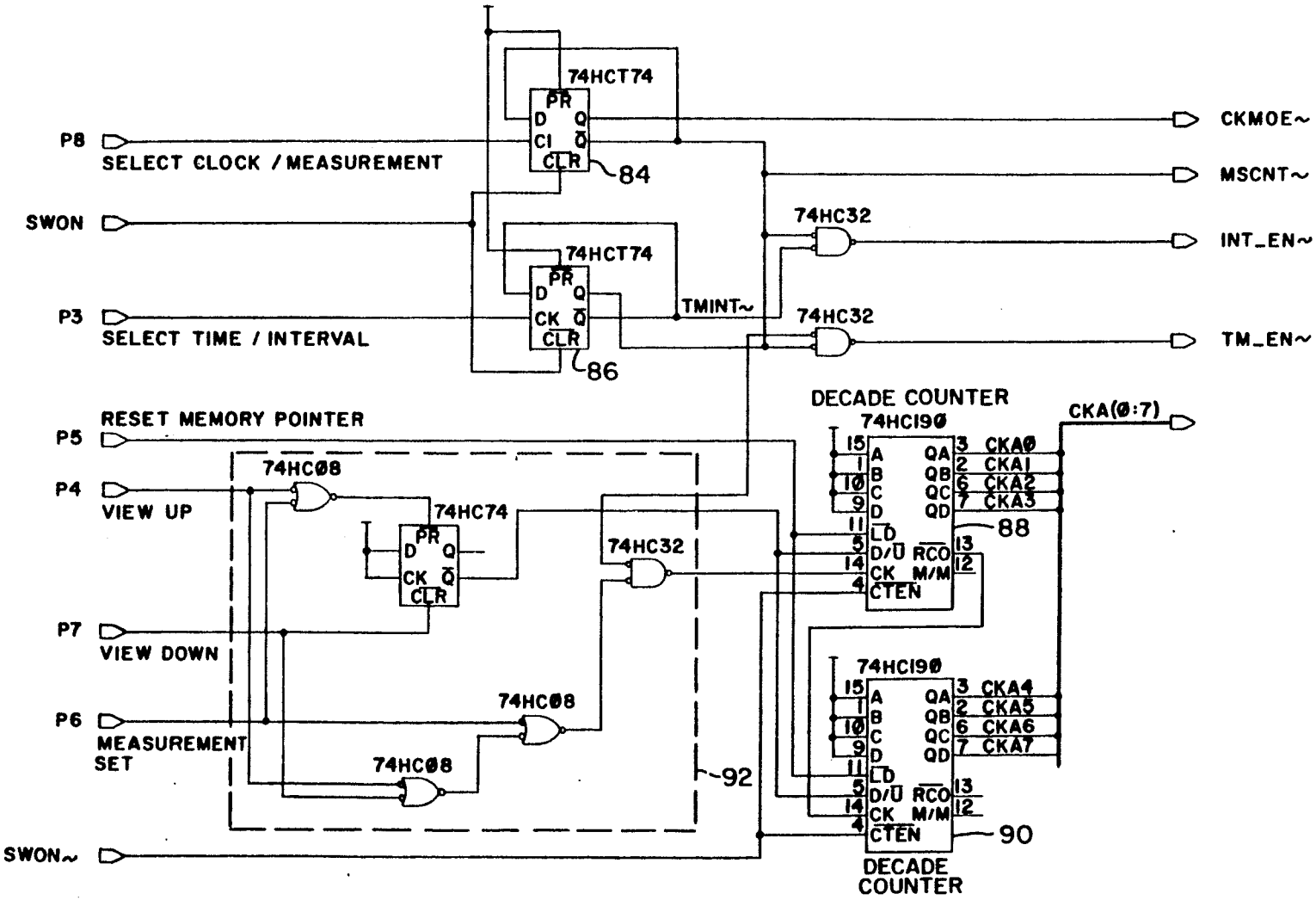
FIG. 5 is a block diagram illustrating the logic flow of the mode control and index generation circuitry.

FIG. 5 is a block diagram illustrating the logic flow of the mode control and index generation circuitry. When the select clock/measurement input is toggled, flip-flop 84 toggles outputs between clock mode enable CKMOE~ and measure count enable MSCNT~. Similarly, when the select time/interval input is toggled, flip-flop 86 toggles outputs between interval enable INT_EN~ and time enable TM_EN~. The position of the index pointer is determined by the output of the decade counter comprising decade counters 88 and 90. This information is conveyed via the address output bus CKA(0:7) since each memory location has a specific address. This counter can be reset to its initial position by the RESET MEMORY POINTER signal. Likewise the pointer index can be advanced using the VIEW UP signal, or it can be set back using the VIEW DOWN signal and the presence of the MEASUREMENT SET signal. The logic for accomplishing this is contained in block 92.

Figure 6:
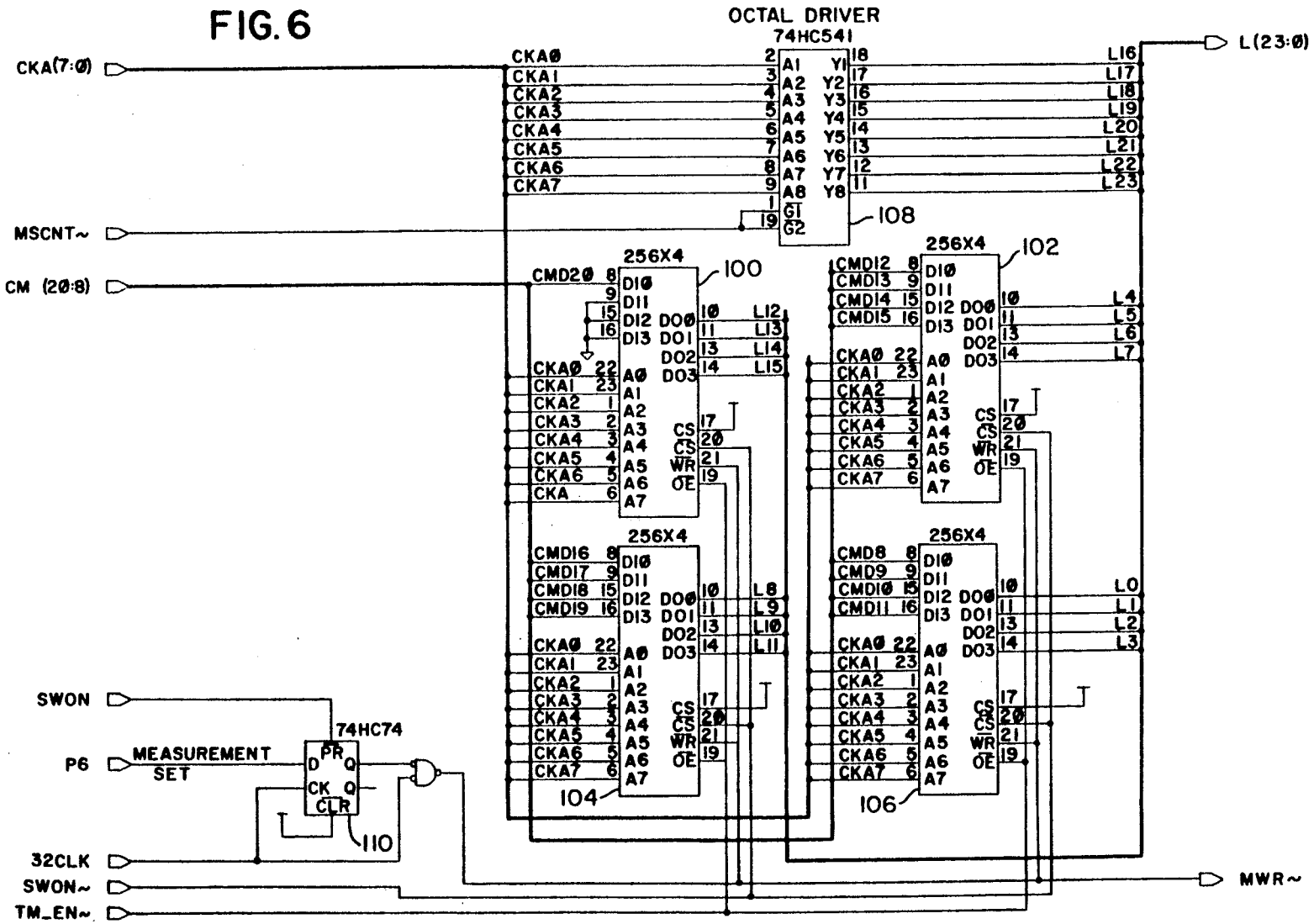
FIG. 6 is a block diagram illustrating the logic flow of the time recording circuitry.

FIG. 6 is a block diagram illustrating the logic flow of the time recording circuitry. The address output bus CKA(7:0) determines the memory address at which the data will be stored in 256-bit×4 memory chips 100, 102, 104, and 106. Each memory address has a unique location in one of the four memories. When the power is on (SWON enabled) the 32 Hz clock 32 CLK is permitted to strobe the memory chips. The address is read into the CKA inputs of the memories and the data output, the time at which the interval measurement began, is output from the 4-bit data outputs DO0–DO3. When measurement count (MSCNT~) is enabled, the 74HC541 octal driver 108 outputs the address index information onto the L(23:0) bus. When time enable TM_EN is enabled, the data is read out onto the L(23:0) bus. When MEASUREMENT SET is enabled, the memories are put into write mode via flip-flop 110 and new data can be written into the indexed location and the memory write MWR signal is energized.

Figure 7:
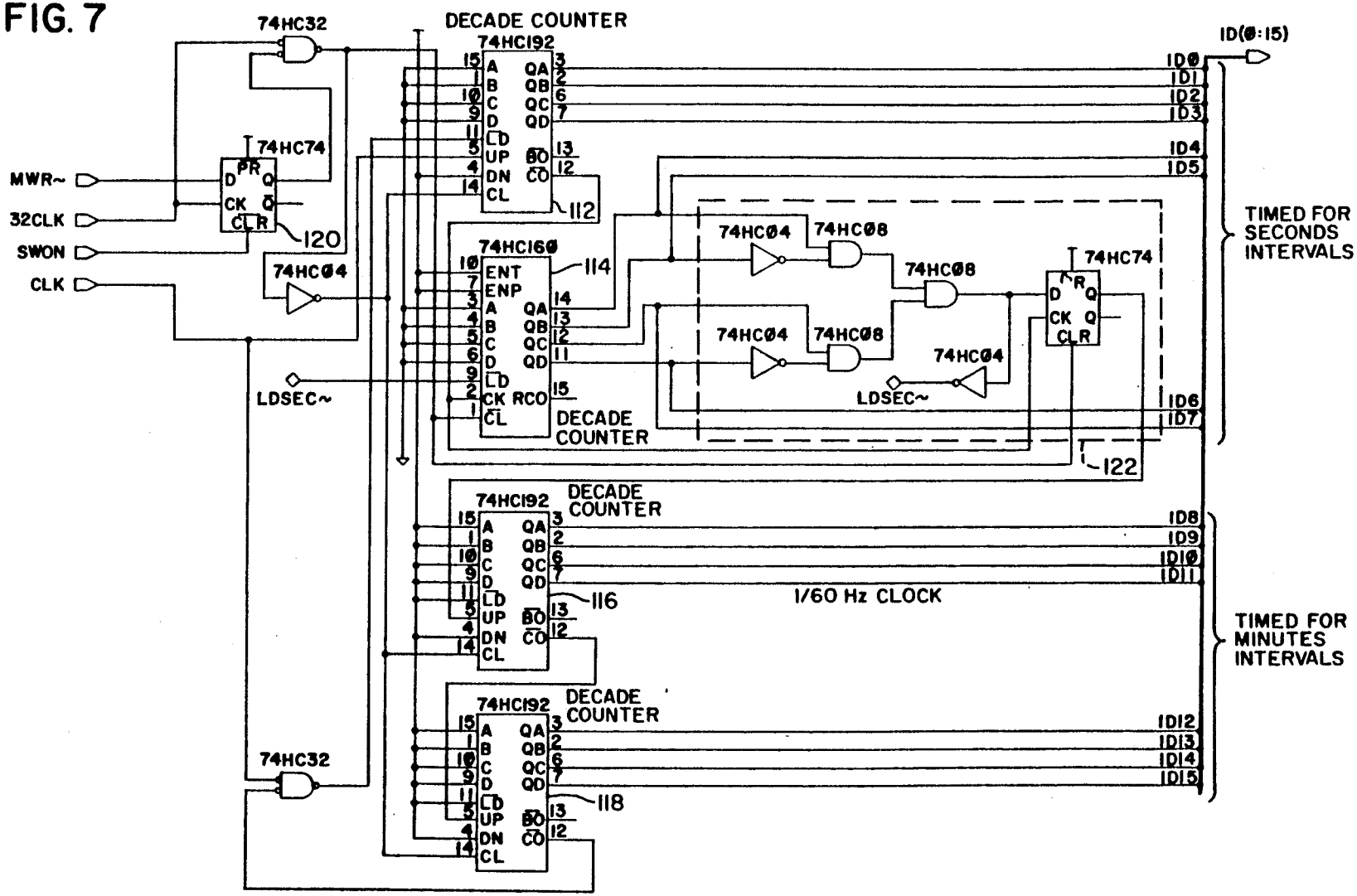
FIG. 7 is a block diagram illustrating the logic flow of the time interval measurement circuitry.

FIG. 7 is a block diagram illustrating the logic flow of the time interval measurement circuit. When memory write MWR is enabled each of the counters 112, 114, 116, and 118 are reset to zero via flip-flop 120. The 32 Hz clock 32 CLK drives the decade counter comprising 74HC192 decade counter 112 and 74HC160 decade counter 114 producing a seconds count output, interval data ID(0–7). The 1/60th Hz clock is generated by logic block 122. This clock is used to driver the decade counter comprising 74HC192 decade counter 116 and 74HC192 decade counter 118 producing an hours count output ID(8–15).

Figure 8:
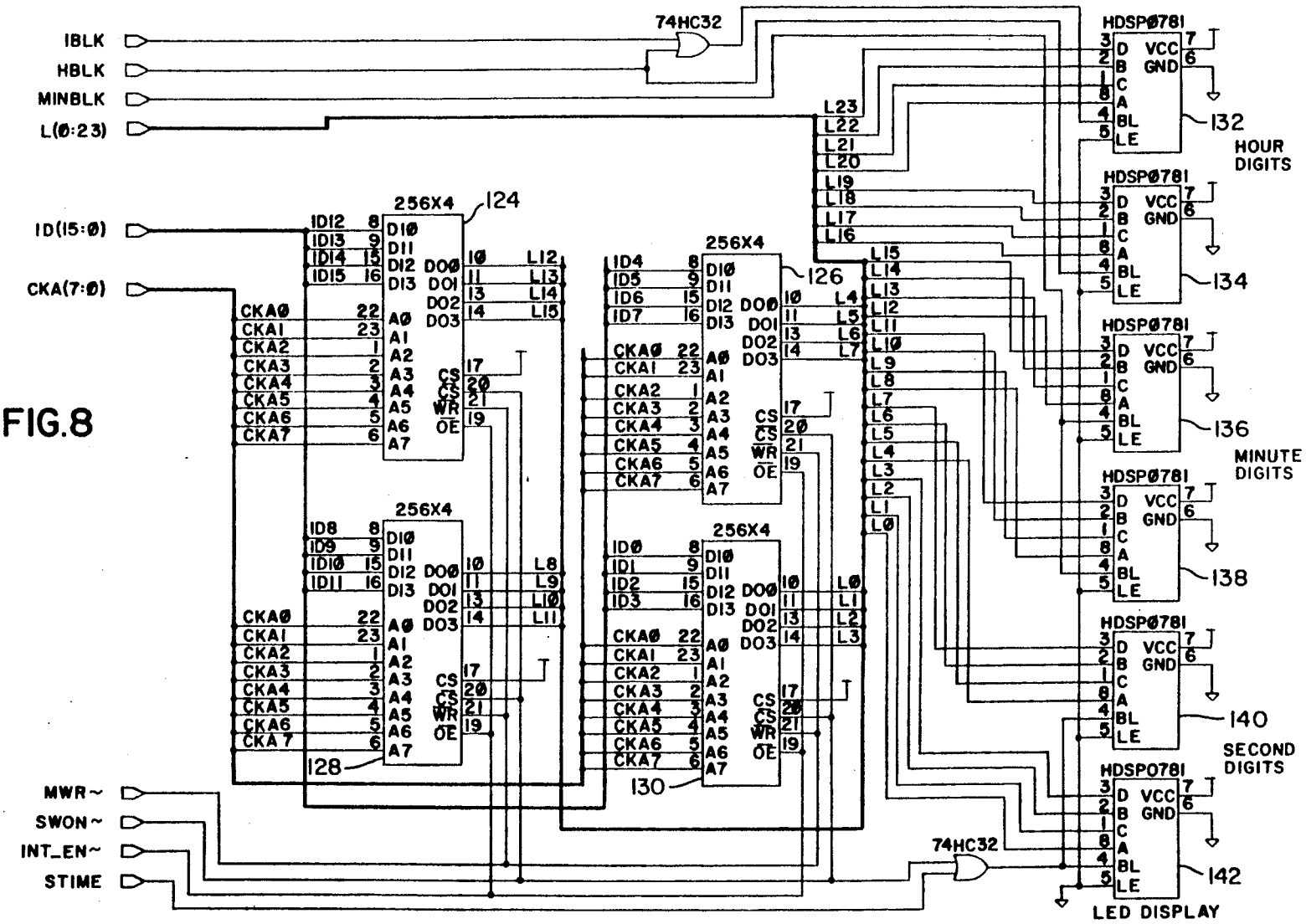
FIG. 8 is a block diagram illustrating the logic flow of the interval recording and display circuitry.

FIG. 8 is a block diagram illustrating the logic flow of the interval recording and display circuitry. For memory chips 124, 126, 128 and 130, the memory address is set by the CKA(7:0) bus. The interval count from FIG. 7 is input via the ID(15:0) bus. When interval enable INT_EN is enabled the OE, overwrite enables, on the memories are set. When the memory write MWR is enabled, the last interval count is stored at the appropriate memory address. The memory chips mentioned throughout this discussion may be Cypress Semiconductor CY7C122 static RAMs, or any other memory type. The output L(23-0) drives the HDSP0781 LED display, available from Hewlett-Packard. This comprises 132 and 134 for the hours digits, 136 and 138 for the minutes digits, and 140 and 142 for the seconds digits. The 1BLK, HBLK and MINBLK are used for blanking or blinking as previously described. The integrated circuits from the ubiquitous high speed CMOS series, HC, are typically available from the Signetics Corp. a subsidiary of U.S Philips Corporation, although other integrated circuits with similar functions will create a functional digital multi event timer.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A digital multi event timer for use in childbirth, comprising:

a) an electronic time base for generating clock signals corresponding to the actual time in hours, minutes and seconds;

b) an electronic counter for generating interval signals corresponding to elapsed time;

c) a display that visually presents, in hours, minutes and seconds, both the actual time and the elapsed time;

d) means for generating elapsed time data for successive time intervals as well as the actual time at which each interval began;

e) means for storing the interval data and data of the actual time that each interval began for subsequent visual presentation by the display; and f) means for reading the interval data and actual time data from the storing means to the display.

2. A digital multi event timer, as recited in claim 1, wherein said means for generating elapsed time data for successive time intervals as well the time at which the interval began comprises an interval timer counter and an index counter, such that when an event begins said interval counter counts up from zero and continues to count until said event is over.

3. A digital multi event timer, as recited in claim 2, wherein said interval counter determines an address at which said interval information is stored.

4. A digital multi event timer, as recited in claim 3, wherein said interval counter is automatically indexed by one address position each time another event is stored.

5. A digital multi event timer, as recited in claim 4, wherein said interval counter further provides means for manually incrementing or decrementing in order to allow a user to select a data set of interest.

6. A digital multi event timer, as recited in claim 1, wherein said means for storing the interval and actual time date comprises two memory banks, one for storing the time at which an interval measurement began, and another for storing the interval and its index.

7. A digital multi event timer, as recited in claim 6, wherein said memory banks comprise a volatile memory.

8. A digital multi event timer, as recited in claim 7, wherein said volatile memory is a Static Random Access Memory.

9. A digital multi event timer, as recited in claim 7, wherein said volatile memory is a Dynamic Random Access Memory.

10. A digital multi event timer, as recited in claim 6, wherein said memory banks comprise a nonvolatile memory.

11. A digital multi event timer, as recited in claim 10, wherein said non volatile memory is an Electrically Erasable Programmable Read Only Memory.

12. A digital multi event timer, as recited in claim 10, wherein said non volatile memory is a Flash Memory.

13. A digital multi event timer, as recited in claim 1, further comprising means for setting the correct actual time.

14. A digital multi event timer, as recited in claim 13, wherein said means for setting the correct actual time comprise decade counters with UP inputs, wherein said UP inputs are connected to a push button switch.

15. A digital multi event timer, as recited in claim 1, wherein said electronic time base comprises a crystal clock; a first decade counter that takes said clock and produces a BCD seconds signal; a second decade counter that takes the divided down output from said first counter to produce a minutes signal; and, a third decade counter that takes the divided down output from said second counter to produce an hours signal.

16. A digital multi event timer, as recited in claim 1, wherein said visual display is a Light Emitting Diode display.

17. A digital multi event timer, as recited in claim 1, wherein said visual display is a Liquid Crystal display.

18. A digital multi event timer, as recited in claim 1, wherein said visual display is a Gas Plasma Display.

19. A digital multi event timer, as recited in claim 1, wherein said visual display is an Electroluminescent Display.

20. A digital multi event timer as recited in claim 1, in which the reading means reads the interval data and the actual time data to the display alternately.

* * * * *